US009805645B2

(12) United States Patent
Jang et al.

(10) Patent No.: US 9,805,645 B2
(45) Date of Patent: Oct. 31, 2017

(54) ORGANIC LIGHT EMITTING DISPLAY APPARATUS AND METHOD OF DRIVING THE SAME

(71) Applicant: SAMSUNG DISPLAY CO., LTD., Yongin, Gyeonggi-Do (KR)

(72) Inventors: Wooseok Jang, Yongin (KR); Dongki Eun, Yongin (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 84 days.

(21) Appl. No.: 14/799,811

(22) Filed: Jul. 15, 2015

(65) Prior Publication Data

US 2016/0163257 A1 Jun. 9, 2016

(30) Foreign Application Priority Data

Dec. 4, 2014 (KR) ..... 10-2014-0173246

(51) Int. Cl.

*G09G 3/32* (2016.01)
*G09G 3/3225* (2016.01)
*G09G 3/20* (2006.01)

(52) U.S. Cl.

CPC ..... *G09G 3/3225* (2013.01); *G09G 3/2022* (2013.01); *G09G 2310/0289* (2013.01); *G09G 2310/08* (2013.01); *G09G 2320/029* (2013.01); *G09G 2330/021* (2013.01)

(58) Field of Classification Search

CPC ..... G09G 3/3225; G09G 3/2022; G09G 2310/0289; G09G 2310/08; G09G 2320/029; G09G 2330/021

See application file for complete search history.

(56) References Cited

U.S. PATENT DOCUMENTS

2011/0267341 A1* 11/2011 Jung ..... G09G 3/003 345/419
2012/0026155 A1* 2/2012 Komiya ..... G09G 3/003 345/213
2012/0146990 A1* 6/2012 Kim ..... G09G 3/3258 345/214

(Continued)

FOREIGN PATENT DOCUMENTS

KR 10-2012-0065138 A 6/2012
KR 10-2013-0131668 A 12/2013
KR 10-2013-0131938 A 12/2013

*Primary Examiner* — Amare Mengistu
*Assistant Examiner* — Jennifer Zubajlo
(74) *Attorney, Agent, or Firm* — Lee & Morse P.C.

(57) ABSTRACT

An organic light emitting display apparatus includes a timing controller, a power supply, a sensor controller, a sensor, and a power controller. The timing controller outputs a vertical synchronization signal. The power supply outputs a first power and a second power to a display through first and second power lines. The sensor controller outputs a sensor control signal synchronized with the vertical synchronization signal. The sensor measures current flowing through the first power line in synchronization with the sensor control signal. The power controller controls the power supply based on the measured current, and the power supply adjusts the voltage level of the first power based on the sensor control signal. The sensor control signal has a period based on dividing the vertical synchronization signal.

18 Claims, 7 Drawing Sheets

(56) References Cited

U.S. PATENT DOCUMENTS

| | | | | |
|---|---|---|---|---|
| 2013/0002736 | A1* | 1/2013 | Park | G09G 3/3225 345/691 |
| 2013/0050068 | A1* | 2/2013 | Inoue | G01J 1/4204 345/102 |
| 2013/0235016 | A1* | 9/2013 | Seo | G09G 3/3208 345/212 |
| 2013/0314385 | A1* | 11/2013 | Kim | G09G 3/3225 345/204 |
| 2013/0314456 | A1* | 11/2013 | Kim | G09G 3/2029 345/691 |
| 2014/0084792 | A1* | 3/2014 | Oh | H05B 37/02 315/120 |
| 2014/0168038 | A1* | 6/2014 | Kim | G09G 3/3208 345/82 |
| 2016/0163278 | A1* | 6/2016 | Pappas | G09G 5/00 345/212 |

* cited by examiner

ORGANIC LIGHT EMITTING DISPLAY APPARATUS AND METHOD OF DRIVING THE SAME

CROSS-REFERENCE TO RELATED APPLICATION

Korean Patent Application No. 10-2014-0173246, filed on Dec. 4, 2014, and entitled, "Organic Light Emitting Display Apparatus and Method Of Driving The Same," is incorporated by reference herein in its entirety.

BACKGROUND

1. Field

One or more embodiments described herein relate to an organic light emitting display apparatus and a method for driving an organic light emitting display apparatus.

2. Description of the Related Art

Various types of flat displays have been developed to replace heavy and large cathode ray tube displays. Examples of flat displays include liquid crystal displays, field emission displays, plasma displays, and organic light emitting displays. Organic light emitting displays are thin and light and have wide viewing angles, fast response times, and low power consumption. In an organic light emitting display, the organic light emitting diode in each pixel emits light based on a recombination of electrons and holes. The amount of light emitted varies according to the amount of current flowing in the organic light emitting diode.

SUMMARY

In accordance with one or more embodiments, an organic light emitting display apparatus includes a timing controller to output a vertical synchronization signal; a display to displaying a frame of image data based on the vertical synchronization signal; a power supply to output first power and second power to the display through first and second power lines, respectively; a sensor controller to output a sensor control signal synchronized with the vertical synchronization signal; a sensor to measure current flowing through the first power line in synchronization with the sensor control signal; and a power controller to compare the measured current with a reference current value and to control the power supply based on results of the comparison, the power supply to be controlled to adjust a voltage level of the first power in synchronization with the sensor control signal, wherein the sensor control signal has a period based on dividing the vertical synchronization signal.

The power controller may generate a first delta value based on the results of the comparison, and adjust the voltage level of the first power to correspond to a value based on a sum of the voltage level of the first power and the first delta value. When the value obtained by adding the voltage level of the first power and the first delta value is lower than a first critical vale, the power controller may adjust the voltage level of the first power to be the first critical value.

The sensor may measure a voltage between the first and second power lines, and the power controller may adjust the voltage level of the first power based on the measured voltage. The vertical synchronization signal may be divided with a dividing ratio of 3. The power controller may control the power supply to adjust the voltage level of the first power once during each of a plurality of periods of the sensor control signal.

The display may include a plurality of pixels, each of the pixels may include at least one sub-pixel, and the power supply may output the first power to the at least one sub-pixel of each of the pixels through different power lines according to types of the sub-pixels. The sensor may measure current respectively flowing through the different power lines, and the power controller may control the power supply based on the current respectively measured at the different power lines, in order to independently adjust the first power output through the different power lines.

The display may include a plurality of pixel rows, a plurality of scan lines respectively connected to the pixel rows, and a plurality of data lines, each of the rows including a plurality of pixels, and the organic light emitting display apparatus may include a gate driver to output a scan signal to the scan lines; and a source driver to output data signals to the data lines in synchronization with the scan signal.

The frame may include a plurality of sub-frames, and each of the sub-frames may be for an image corresponding to a bit of the data signal, the frame may expressed based on a sum of emitting periods of the sub-frames. One of the sub-frames corresponding to a most significant bit of the data signal may have a longest emitting period, and another of the sub-frames corresponding to a least significant bit of the data signal may have a shortest emitting period. The emitting periods of the sub-frames may be different from each other based on a ratio of $2^n$.

The gate driver may sequentially output the scan signal to the scan lines according to each of the sub-frames, and the display may simultaneously display image data corresponding to each of the sub-frames through pixels connected to the scanned scan lines. The gate driver may individually output the scan signal to the scan lines according to timings individually determined for each of the scan lines, and the display may individually display each of the sub-frames through pixels connected to the scanned scan lines according to the timings individually determined for each of the scan lines.

In accordance with one or more other embodiments, a method for driving an organic light emitting display apparatus includes outputting first power and second power to a display through first and second power lines, respectively; generating a sensor control signal based on a divided vertical synchronization signal; measuring current flowing through the first power line in synchronization with the sensor control signal; comparing the measured current with a reference current value; and adjusting a voltage level of the first power based on the comparison.

Adjusting the voltage level may include generating a first delta value based on the comparison, and adjusting the voltage level of the first power to correspond to a value obtained by adding the voltage level of the first power and the first delta value. When the value obtained by adding the voltage level of the first power and the first delta value is lower than a first critical value, adjusting the voltage level may include adjusting the voltage level of the first power to be the first critical value.

Measuring the current may be performed by measuring a voltage between the first and second power lines in synchronization with the sensor control signal, and adjusting the voltage level may be performed by adjusting the voltage level of the first power based on the measured voltage. Adjusting the voltage level maybe performed once during each of a plurality of periods of the sensor control signal.

In accordance with one or more other embodiments, an apparatus includes an interface; and a controller to control a display, the controller to: output first power and second power to the display through respective first and second power lines; generate a sensor control signal based on a control signal; measure current flowing through the first power line based on the sensor control signal; and adjust a voltage level of the first power based on the measured current. The control signal may be based on a signal from a timing controller of the display.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
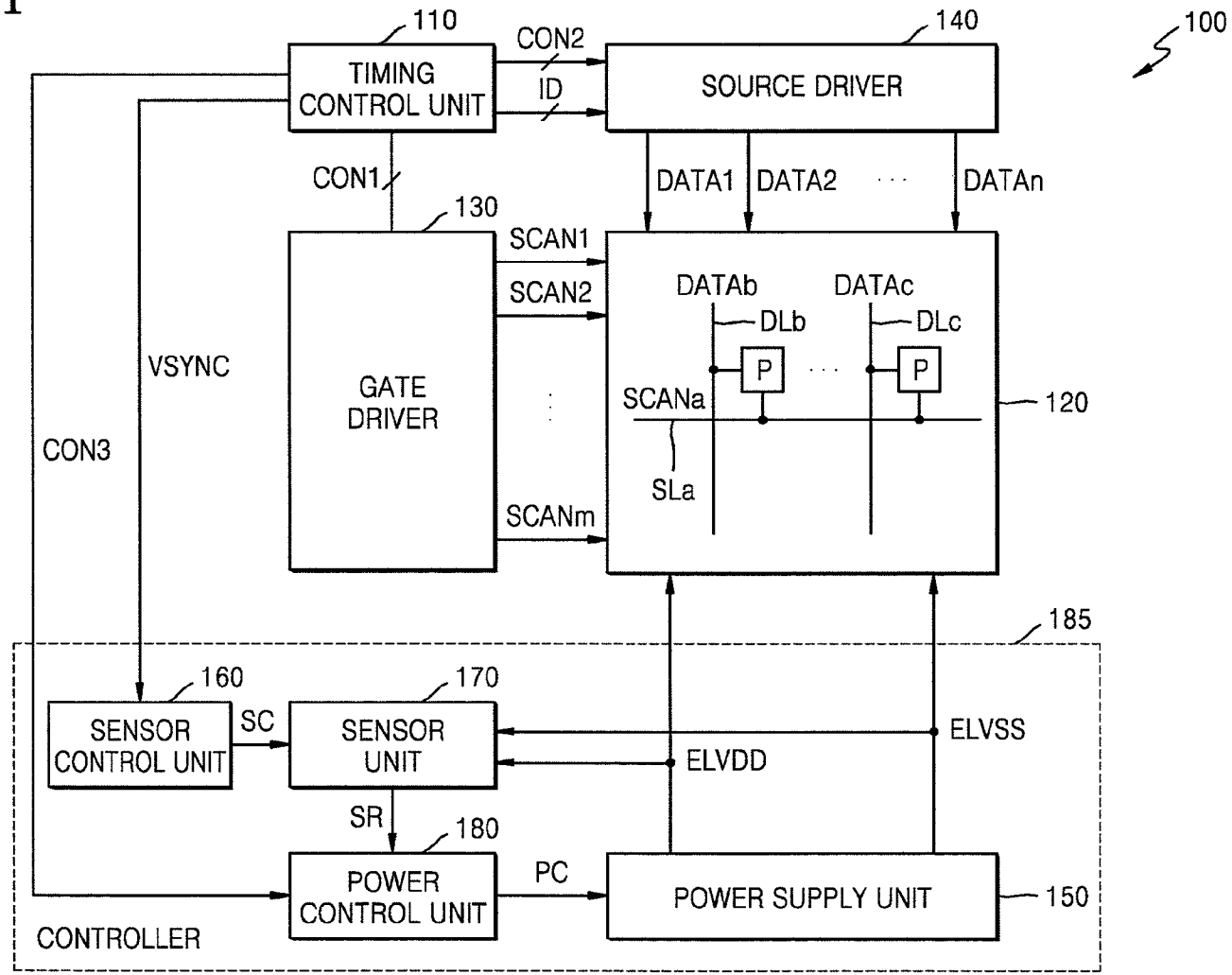
FIG. 1 illustrates an embodiment of an organic light emitting display.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout.

FIG. 1 illustrates an embodiment of an organic light emitting display apparatus 100 which includes a timing control unit 110, a display unit 120, a gate driver 130, a source driver 140, a power supply unit 150, a sensor control unit 160, a sensor unit 170, and a power control unit 180. The timing control unit 110, the gate driver 130, and the source driver 140 may be respectively formed on separate semiconductor chips or may be integrated on a single semiconductor chip. In addition, the timing control unit 110, the gate driver 130, and/or the source driver 140 may be formed on the same substrate as the display unit 120.

The organic light emitting display apparatus 100 displays images based on light emitted from pixels P. The organic light emitting display apparatus 100 may be an electronic apparatus, e.g., a smartphone, a personal or laptop computer, a monitor, or a TV, or may be an image display component of such an electronic apparatus.

The timing control unit 110 is connected to the gate driver 130. the source driver 140, the sensor control unit 160, and the power control unit 180. The timing control unit 110 receives image data and outputs first control signals CON1 to the gate driver 130. The first control signals CON1 may include a vertical synchronization signal VSYNC. The first control signals CON1 may include control signals necessary for the gate driver 130 to output scan signals SCAN1 TO SCANm synchronized with the vertical synchronization signal VSYNC. The timing control unit 110 outputs second control signals CON2 to the source driver 140.

The timing control unit 110 outputs image data ID to the source driver 140. The image data ID may include image information necessary for generating data signals DATA1 to DATAn. The second control signals CON2 may include control signals necessary for the source driver 140 to output the data signals DATA1 to DATAn corresponding to the image data ID. The timing control unit 110 may output the vertical synchronization signal VSYNC to the sensor control unit 160. The timing control unit 110 may output third control signals CON3 to the power control unit 180.

The display unit 120 includes a plurality of pixel rows each including a plurality of pixels P, a plurality of scan lines SL respectively connected to the pixel rows, and a plurality of data lines DL. Each scan line SL is connected to pixels P in the same pixel row for delivering scan signals. The data lines DL may be connected to pixels P in the same pixel column to deliver data signals. For example, as illustrated in FIG. 1, a pixel row may include a plurality of pixels P, a scan line SLa may be connected to the pixels P of the pixel row, and a plurality of data lines DLb and DLc may be respectively connected to the pixels P.

Each pixel P includes a pixel circuit that receives first power ELVDD and second power ELVSS and controls a driving current. Each pixel P may include an organic light emitting diode to emit light having a degree of luminance corresponding to a driving current. The pixel circuit may output a driving current based on the first power ELVDD, the second power ELVSS, and a data signal, and may supply the driving current to an anode of the organic light emitting diode. The organic light emitting diode may emit light corresponding to a current flowing between its anode and a cathode.

The gate driver 130 outputs scan signals SCAN I to SCANm to the scan lines SL, for example, in synchronization with the vertical synchronization signal VSYNC.

The source driver 140 outputs the data signals DATA1 to DATAn to the data lines DL in synchronization with the scan signals SCAN1 TO SCANm.

The power supply unit 150 outputs the first power ELVDD and the second power ELVSS to the display unit 120 through first and second power lines, respectively. The power supply unit 150 outputs power to the display unit 120 for operating the display unit 120.

The sensor control unit 160 generates a sensor control signal SC which, for example, may be synchronized with the vertical synchronization signal VSYNC. The sensor control signal SC is transmitted to the sensor unit 170. The sensor control unit 160 may generate the sensor control signal SC by dividing the vertical synchronization signal VSYNC. For example, if the period of the vertical synchronization signal VSYNC is t, the period of the sensor control signal SC may be k*t, where k denotes an integer equal to or greater than 2. A method for generating the sensor control signal SC by dividing a vertical synchronization signal VSYNC may be selected from various signal dividing methods using signal processing algorithms.

The sensor unit 170 measures current flowing in the first power line in order to detect current corresponding to the first power ELVDD output from the power supply unit 150. The sensor unit 170 may measure a voltage between the first and second power lines in order to detect a voltage difference between the first power ELVDD and the second power ELVSS output from the power supply unit 150. The sensor unit 170 may perform a measurement operation in synchronization with the sensor control signal SC, and may output a measurement result signal SR to the power control unit 180.

The power control unit 180 may adjust the voltage level of the first power ELVDD output from the power supply unit 150 based on measurement result signal SR.

Figure 2:
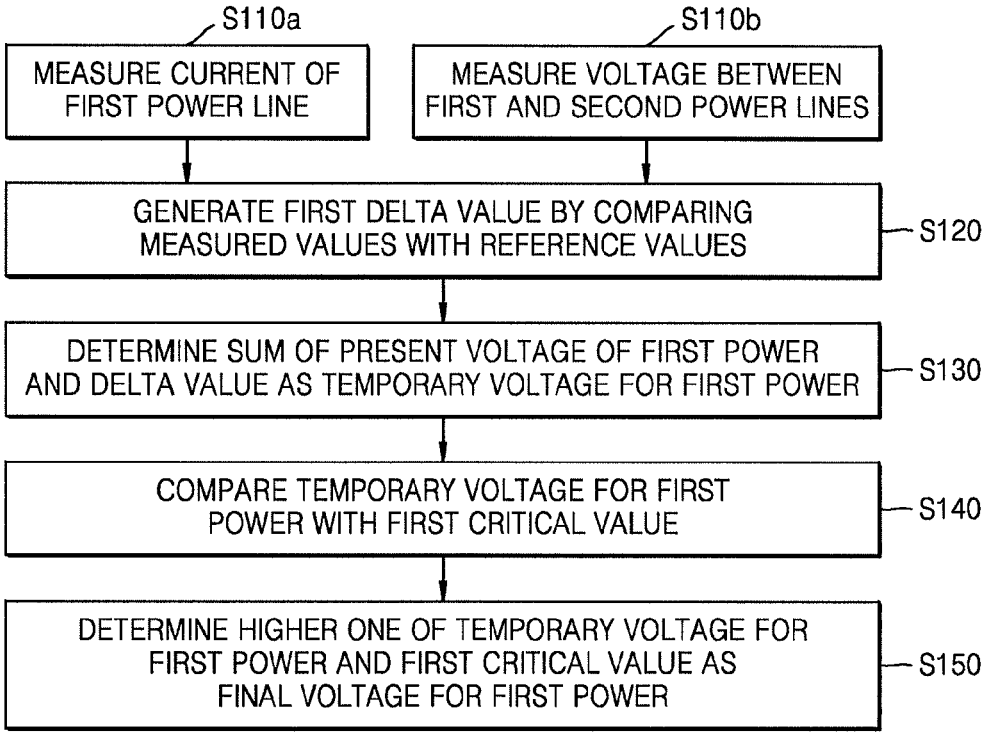
FIG. 2 illustrates an embodiment of a method for driving an organic light emitting display.

FIG. 2 illustrates an embodiment of a method for driving the organic light emitting display apparatus 100. Referring to FIG. 2, the method includes measuring current flowing in the first power line (operation S110*a*), measuring a voltage between the first and second power lines (operation S110*b*), generating a first delta value by comparing measured values with reference values (operation S120), determining the sum of the present voltage of first power and the first delta value as a temporary voltage for the first power (operation S130), comparing the temporary voltage of the first power with a first critical value (operation S140), and determining the higher one of the temporary voltage and the first critical value as a final voltage for the first power (operation S150).

In the current measuring operation S110*a,* current flowing in the first power line is measured to detect a current corresponding to the first power ELVDD supplied to the display unit 120.

In the voltage measuring operation S110*b,* a voltage between the first and second power lines is measured to detect a voltage difference between the first power ELVDD and second power ELVSS. Both or only one of the current measuring operation S110*a* or the voltage measuring operation S110*b* may be performed. The current measuring operation S110*a* and the voltage measuring operation S110*b* may be performed by the sensor unit 170.

In the first delta value generating operation S120, the measured values are compared with the reference values to generate the first delta value for adjusting the voltage level of the first power ELVDD. When only one of the current measuring operation S110*a* or the voltage measuring operation S110*b* is performed, a value measured by the performed operation is compared with only a single reference value. When both the current measuring operation S110*a* and the voltage measuring operation S110*b* are performed, two measured results are compared with respective reference values. The first delta value generating operation S120 may be performed by the power control unit 180.

The reference value for the measured value in the current measuring operation S110*a* may be a target value of current to be supplied from the power supply unit 150 to the display unit 120. The reference value for the measured value in the voltage measuring operation S110*b* may be a difference between target voltages of the first power ELVDD and the second power ELVSS to be supplied from the power supply unit 150 to the display unit 120. The first delta value may be a difference between the present voltage level of the first power ELVDD and a target voltage level for the first power ELVDD. For example, the first delta value may indicate how much the present voltage level of the first power ELVDD has to be adjusted when compared to the reference value.

In the temporary voltage determining operation S130, the sum of the first delta value and the present voltage level of the first power ELVDD may be determined as the temporary voltage for the first power ELVDD. The temporary voltage determining operation S130 may be performed by the power control unit 180.

In the comparing operation S140, the temporary voltage for the first power ELVDD may be compared with the first critical value. The first critical value is predetermined value. In one embodiment, the first critical value is a minimal value determined as a voltage level of the first power ELVDD. In the comparing operation S140, it may be determined whether the temporary voltage of the first power ELVDD obtained by measurement and calculation is lower than the first critical value. The comparing operation S140 may be performed by the power control unit 180.

In the final voltage determining operation S150, if the temporary voltage for the first power ELVDD is lower than the first critical value, the first critical value may be determined as the final voltage for the first power ELVDD, and thus the voltage level of the first power ELVDD is not adjusted to an excessively low value. In the final voltage determining operation S150, if the temporary voltage for the first power ELVDD is higher than the first critical value, the temporary voltage for the first power ELVDD may be determined as the final voltage for the first power ELVDD. In the final voltage determining operation S150, the voltage level of the first power ELVDD may be adjusted to be the final voltage. The final voltage determining operation S150 may be performed by the power control unit 180.

Figure 3:
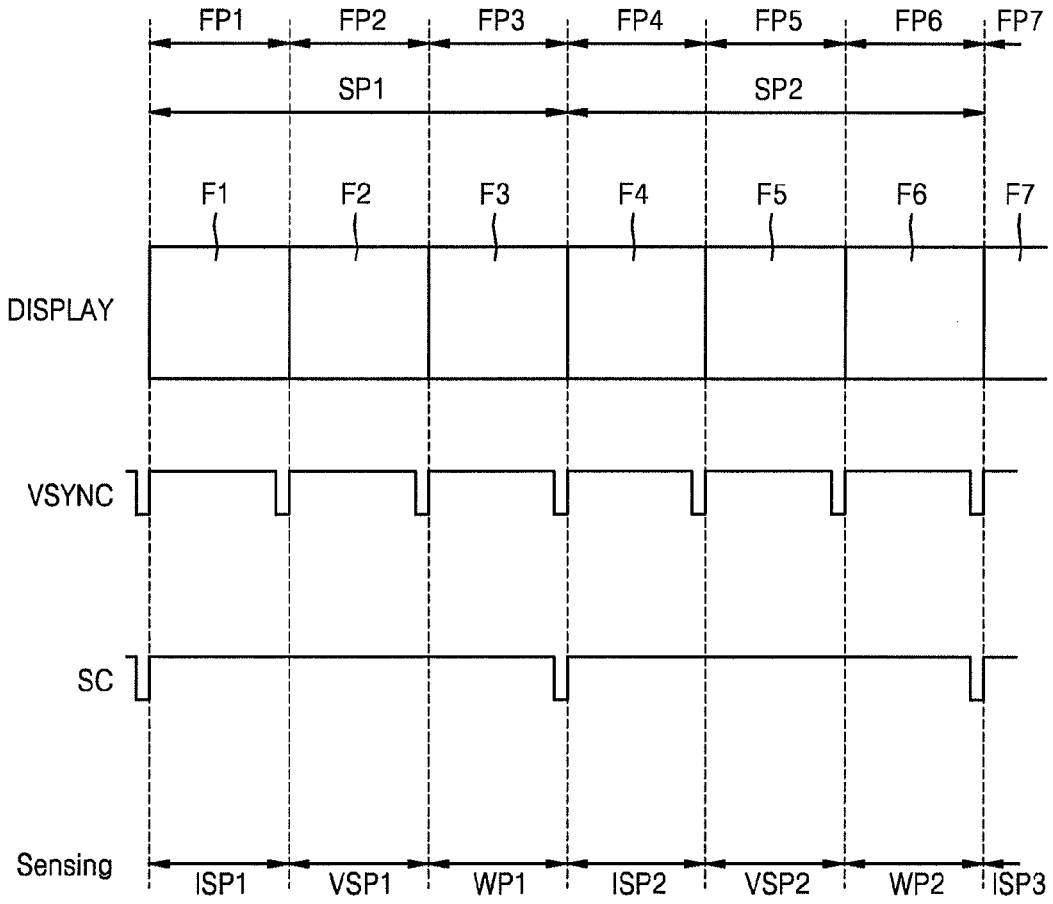
FIG. 3 illustrates an embodiment of a method for measuring the level of a power voltage and current flowing in a power voltage line in an organic light emitting display.

FIG. 3 illustrates an embodiment of a method for measuring the level of power voltage and current flowing in a power voltage line in the organic light emitting display apparatus 100. Referring to FIG. 3, frame images are sequentially displayed according to frame periods in synchronization with a vertical synchronization signal VSYNC.

For example, a first frame image F1 is displayed on the display unit 120 during a first frame period FP1, and a second frame image F2 is displayed on the display unit 120 during a second frame period FP2. A sensor control signal SC is generated by dividing the vertical synchronization signal VSYNC such that a pulse is sequentially present on the sensor control signal SC in each period corresponding to a certain number of frame periods. In one embodiment, if a dividing ratio is 3, the period of the sensor control signal SC is three times each frame period FP, and each sensor sensing period SP is three times each frame period FP. Thus, a first sensing period SP1 lasts for first to third frame periods FP1 to FP3, and a second sensing period SP2 lasts for fourth to sixth frame periods FP4 to FP6.

The sensor unit 170 may perform a measuring operation in each sensing period SP in synchronization with the sensor control signal SC. For example, the sensor unit 170 may measure a current flowing in the first power line while the first frame image F1 is displayed during a first current sensing period ISP1 in synchronization with the sensor control signal SC, and may measure a voltage between the first and second power lines while the second frame image F2 is displayed during a first voltage sensing period VSP1 in synchronization with the vertical synchronization signal VSYNC.

In the first sensing period SP1, the sensor unit 170 may not perform a measuring operation during a first wait period WP1 after the first current sensing period ISP1 and the first voltage sensing period VSP1. In the exemplary embodiment of FIG. 3, the sensor unit 170 measures current once and voltage once during each sensing period SP. In another exemplary embodiment, the sensor unit 170 may measure current a predetermined number of times and voltage a predetermined number of times during a sensing period SP, or may measure one of current or voltage once or a plurality of times during a sensing period SP.

Current or voltage may be measured a plurality of times during a single sensing period SP, and first power ELVDD may be precisely adjusted based on a plurality of measured values. In the exemplary embodiment of FIG. 3, the dividing ratio is 3. In another exemplary embodiment, the sensor control signal SC may be generated by dividing the vertical synchronization signal VSYNC at a dividing ratio being an integer equal to or greater than 2.

The sensor unit 170 transmits a measurement result signal SR to the power control unit 180. The sensor unit 170 may transmit the measurement result signal SR to the power control unit 180, for example. within (e.g., in the middle of the first wait period WP1. Alternatively, the sensor unit 170 may continuously transmit the measurement result signal SR, and the power control unit 180 may receive the measurement result signal SR in the middle of the first wait period WP1.

During a sensing period SP, based on a measurement result signal SR, the power control unit 180 may adjust the voltage level of the first power ELVDD to be output in the next sensing period SP. For example, the power control unit 180 may determine a final voltage level of the first power ELVDD through the operations described with reference to FIG. 2 based on a measurement result signal SR measured in the first sensing period SP1. Thereafter, the power control unit 180 may output the determined voltage level to the display unit 120 during the second sensing period SP2.

In this manner, the voltage level of the first power ELVDD, determined using first to third frame images F1 to F3 displayed on the display unit 120 during the first sensing period SP1, may be output to the display unit 120 from the power supply unit 150 in the second sensing period SP2 during which fourth to sixth frame images F4 to F6 are displayed on the display unit 120.

The operation, in which the power control unit 180 adjusts the voltage level of the first power ELVDD to be output in the next sensing period SP based on a measurement result signal SR obtained in the previous sensing period SP, may be performed during a wait period in the previous sensing period SP. For example, the operation, in which the power control unit 180 adjusts the voltage level of the first power ELVDD based on the measurement result signal SR obtained in the first sensing period SP1, may be performed during the first wait period WP1.

Figure 4:
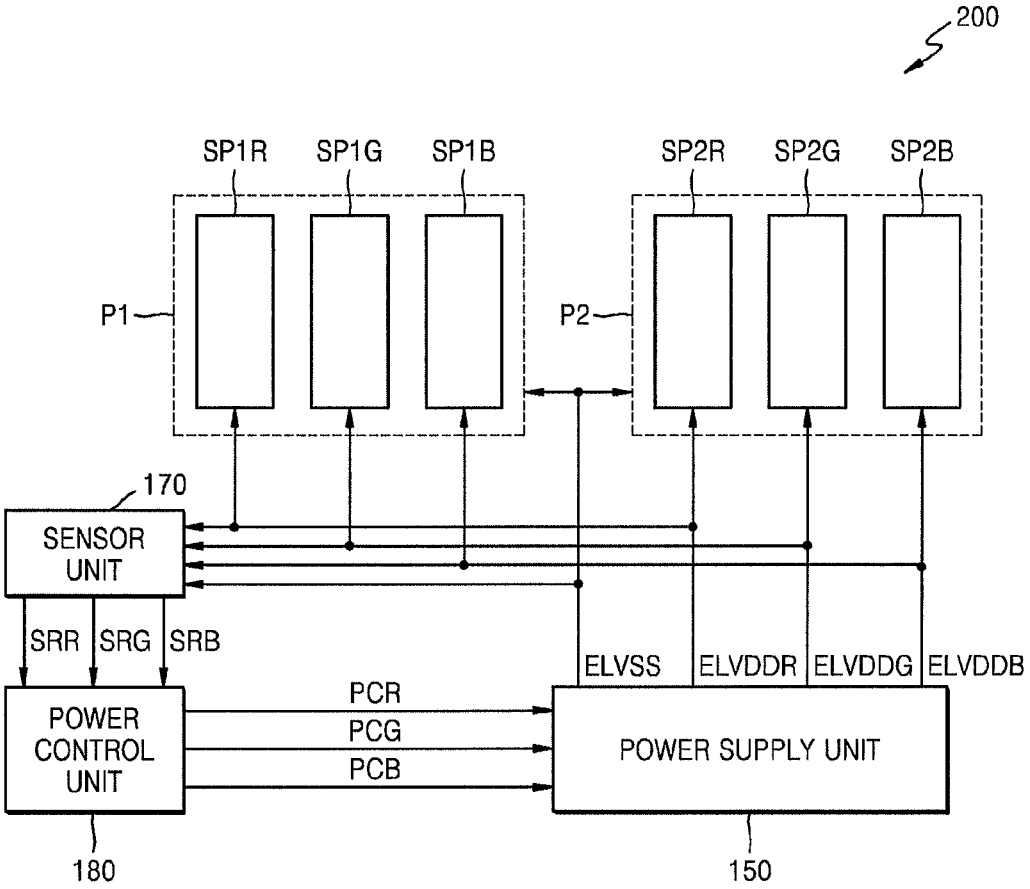
FIG. 4 illustrates another embodiment of an organic light emitting display.

FIG. 4 illustrates another embodiment of an organic light emitting display apparatus 200. The organic light emitting display apparatus 200 is similar to apparatus 100 except as follows.

Referring to FIG. 4, the organic light emitting display apparatus 200 includes a first pixel P1, a second pixel P2, a power supply unit 150, a sensor unit 170, and a power control unit 180. Each pixel includes at least one sub-pixel. For example, as shown in FIG. 4, each of the first pixel P1 and the second pixel P2 may include three sub-pixels. The first pixel P1 includes a first red sub-pixel SP1R, a first green sub-pixel SP1G, and a first blue sub-pixel SP1B. The second pixel P2 includes a second red sub-pixel SP2R, a second green sub-pixel SP2G, and a second blue sub-pixel SP2B.

The types of sub-pixels may be different, for example, according to the wavelengths of light that the sub-pixels are to emit and the positions of the sub-pixels. For example, as illustrated in FIG. 4, the first red sub-pixel SP1R and the second red sub-pixel SP2R may be of same type (e.g., emit light of in a same wavelength range). The first green sub-pixel SP1G and the second green sub-pixel SP2G may be of the same type, and the first blue sub-pixel SP1B and the second blue sub-pixel SP2B may be of the same type.

The power supply unit 150 may supply first power having different levels according to the types of the sub-pixels. For example, first red power ELVDDR may be supplied to the first red sub-pixel SP1R and the second red sub-pixel SP2R. First green power ELVDDG may be supplied to the first green sub-pixel SP1G and the second green sub-pixel SP2G. First blue power ELVDDB may be supplied to the first blue sub-pixel SP1B and the second blue sub-pixel SP2B. Second power ELVSS may be supplied to all the sub-pixels regardless of the types of the sub-pixels.

The sensor unit 170 measures current values or voltage values with respect to different levels of the first power output from the power supply unit 150. For example, the sensor unit 170 may individually measure current flowing in a power line of the first red power ELVDDR, current flowing in a power line of the first green power ELVDDG, and current flowing in a power line of the first blue power ELVDDB. In addition, the sensor unit 170 may individually measure a voltage between the power line of the first red power ELVDDR and a power line of the second power ELVSS, a voltage between the power line of the first green power ELVDDG and the power line of the second power ELVSS, and a voltage between the power line of the first blue power ELVDDB and the power line of the second power ELVSS.

Measurement result signals SRR, SRG, and SRB obtained from different levels of the first power may be output from the sensor unit 170 to the power control unit 180. Based on the measurement result signals SRR, SRG, and SRB, the power control unit 180 adjusts the first red power LEVDDR, the first green power ELVDDG, and the first blue power ELVDDB of the power supply unit 150.

In the exemplary embodiment of FIG. 4, each of the first and second pixels P1 and P2 includes three sub-pixels. In another embodiment, each of the first and second pixels P1 and P2 may include a different number of sub-pixels, e.g., two, four or more sub-pixels.

Figure 5A:
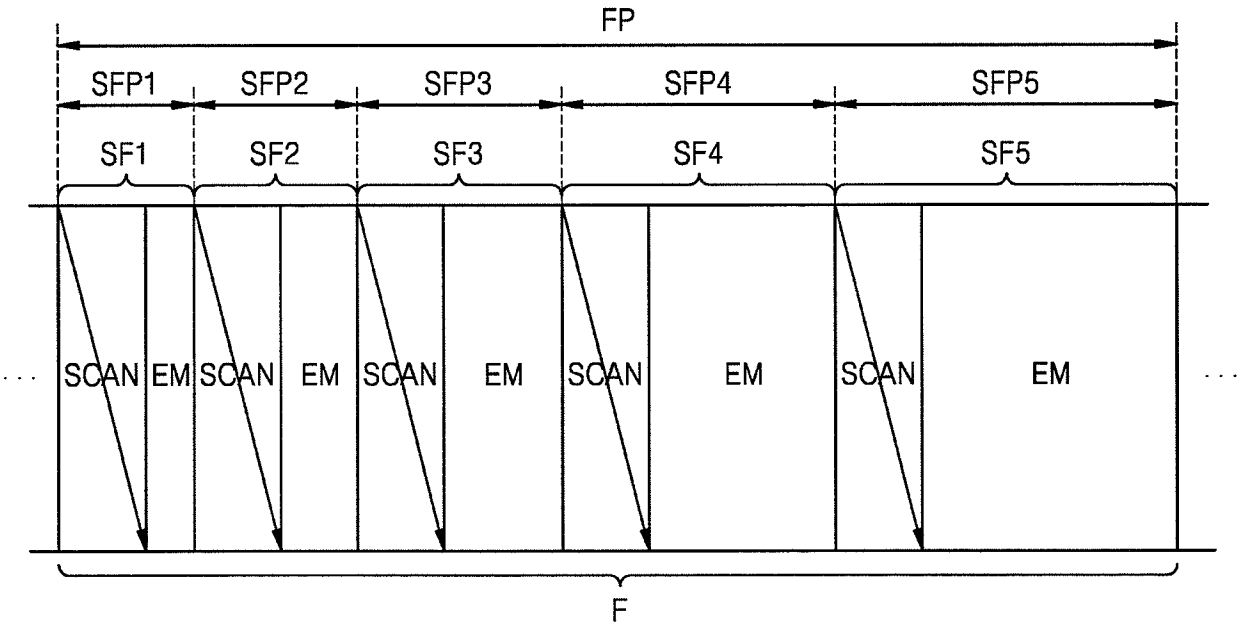
FIGS. 5A and 5B illustrate embodiments relating to a method for driving an organic light emitting display apparatus in a digital driving manner.
Figure 5B:
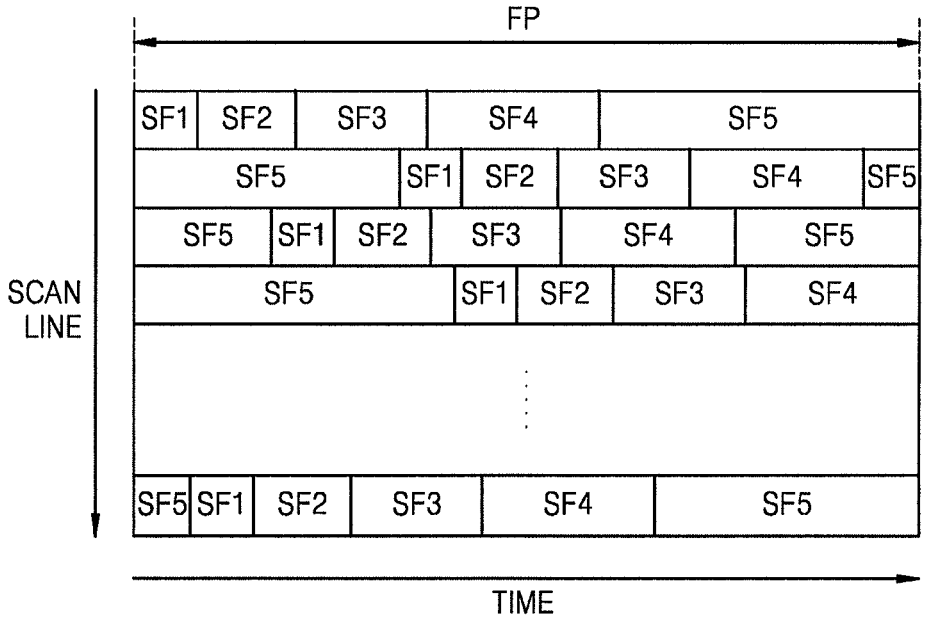

FIGS. 5A and 5B illustrate embodiments of a method for driving the organic light emitting display apparatus 100 and/or 200 in a digital driving manner. Referring to FIGS. 5A and 5B. a frame F may include a plurality of sub-frames SF1 to SF5. A frame period FP may include a plurality of sub-frame periods SFP1 to SFP5. Each sub-frame period SFP1 to SFP5 may include a scan period SCAN and an emitting period EM.

The display unit 120 receives digital data signals. Each digital data signal includes a plurality of bits, each having a high or low level. Each pixel P which receives a digital data signal emits light or may not emit light according to the logical level of the digital data signal.

In addition, the frame F may be processed according to the sub-frames SF1 to SF5. The number of the sub-frames SF1 to SF5 may be determined in various ways. For example, each sub-frame SF1 to SF5 may correspond to a bit of a data signal, and the number of the sub-frames SF1 to SF5 may be equal to the number of the bits of the data signal. In another embodiment, however, the number of the sub-frames SF1 to SF5 may be determined in a different manner and/or the frame F may include a different number of sub-frames.

The sub-frames SF1 to SF5 may be displayed on the display unit 120 during respective sub-frame periods SFP1 to SFP5. Each sub-frame period SFP1 to SFP5 may include a scan period SCAN during which a scan signal is supplied to a pixel P and an emitting period EM during which the pixel P emits light.

The emitting periods EM for the sub-frames SF1 to SF5 may be different and may express bits respectively corresponding to the sub-frames SF1 to SF5. In this case. the emitting periods EM for the sub-frames SF1 to SF5 may increase with a ratio of 2 to the power of n. e.g.. $2^{n}$. For example, the emitting period EM for the second sub frame SPF2 may be twice the emitting period EM for the first sub-frame SF1. The emitting period EM for the third sub-frame SF3 may be twice the emitting period EM for the second sub-frame SF2. The emitting period EM for the fourth sub-frame SF4 may be twice the emitting period EM for the third sub-frame SF3. The emitting period EM for the fifth sub-frame SF5 may be twice the emitting period EM for the fourth sub-frames SF4. The fifth sub-frame SF5 having the longest emitting period EM may correspond to a most significant bit of a data signal, and the first sub-frame SF1 having the shortest emitting period EM may corresponding to a least significant bit of the data signal. In this manner, the level of a gray scale may be expressed based on the sum of the emitting periods EM for the sub-frames SF1 to SF5 of the frame F.

Referring to FIG. 5A, the gate driver 130 may sequentially output scan signals for the sub-frames SF1 to SF5, and the timing control unit 110 may control the display unit 120, the gate driver 130, and the source driver 140, so that pixels P of a plurality of pixel rows of the display unit 120 may emit light at once for each of the sub-frames SF1 to SF5. In this manner, the display unit 120 may be operated by a digital driving method using a progressive scan technique.

Alternatively, as illustrated in FIG. 5B, the gate driver 130 may individually output scan signals to scan lines according to timings respectively determined for the scan lines, and the timing control unit 110 may control the display unit 120, the gate driver 130, and the source driver 140, so that pixels P of the display unit 120 may individually emit light according to a plurality of pixel rows of the pixels P. In this manner, the display unit 120 may be operated by a digital driving method using a random scan technique.

In the organic light emitting display apparatus 100 or 200 operating according to such digital driving methods, the degrees of luminance of pixels P are sensitively varied according to the voltage level of first power ELVDD, compared to the case of organic light emitting displays operating according to analog driving methods. Therefore, if the first power ELVDD is precisely controlled by the method embodiments for driving the organic light emitting display apparatus 100 or 200, the power of the organic light emitting display apparatus 100 or 200 may be easily controlled according to sensitive variations of luminance.

Figure 6:
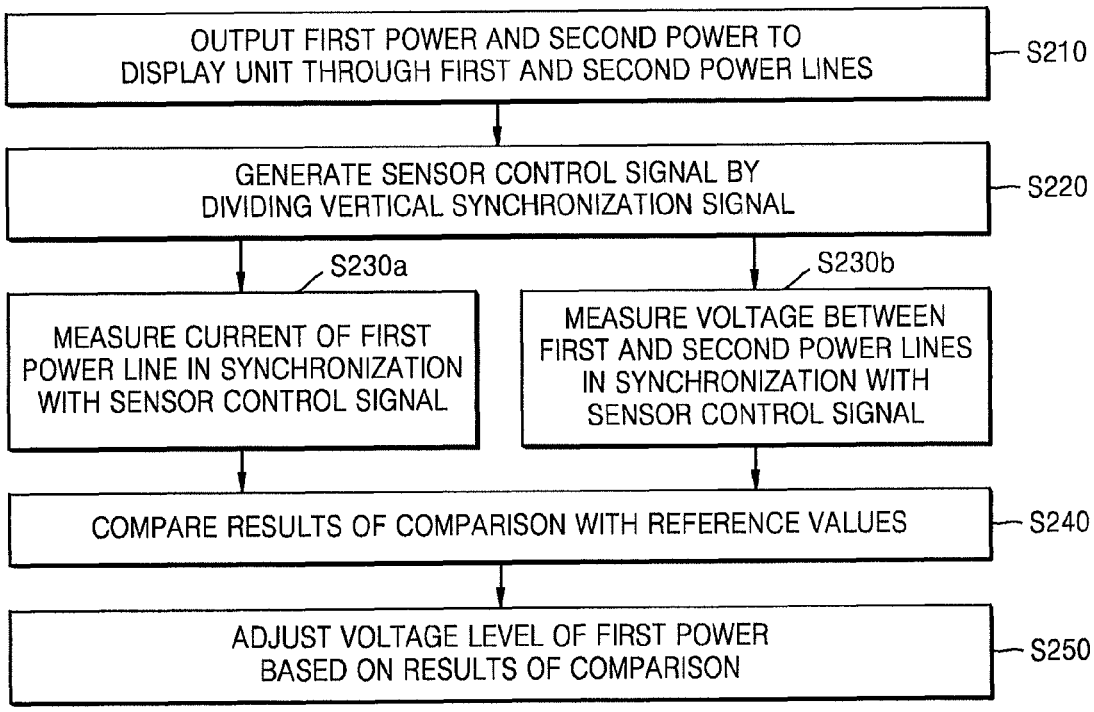
FIG. 6 illustrates another embodiment of a method for driving an organic light emitting display.

FIG. 6 illustrates another embodiment of a method for driving an organic light emitting display apparatus 100 or 200. Referring to FIG. 6, first power and second power may be output to the display unit 120 through the first and second power lines (S210). Next, a sensor control signal may be generated by dividing a vertical synchronization signal (S220). The vertical synchronization signal may be divided by various signal dividing methods using signal processing techniques.

Next, a current flowing through the first power line may be measured in synchronization with the sensor control signal (S230*a*), and a voltage between the first and second power lines may be measured in synchronization with the sensor control signal (S230*b*). Next, results of the measurement may be compared with reference values (S240). Next. the voltage level of the first power may be adjusted based on results of the comparison (S250).

In this manner, the level of power voltage of the organic light emitting display apparatus 100 or 200 or current flowing in the power line may be measured, and the level of power voltage may be adjusted based on results of the measurement.

In accordance with another embodiment, an apparatus includes an interface and controller to control a display. The controller output first power and second power to the display through respective first and second power lines; generate a sensor control signal based on a control signal; measure current flowing through the first power line based on the sensor control signal; and adjust a voltage level of the first power based on the measured current. The control signal may be based on a signal, for example, from the timing control unit 110 of the display panel.

In this embodiment, the interface may take various forms. For example, when the apparatus is embodied within an integrated circuit chip, the interface may be one or more output terminals, leads, wires, ports, signal lines, or other type of interface within or coupled to the apparatus. In this case, the apparatus may be, for example, the controller 185 in FIG. 1. In another case, the interface may be the signal lines coupling the controller 185 to one or more of the timing control unit 110 or the display panel 120.

The control units, controllers, drivers, and other processing features of the embodiments disclosed herein may be implemented in logic which, for example, may include hardware, software, or both. When implemented at least partially in hardware, the control units, controllers, drivers, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the control units, controllers, drivers, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

In accordance with one or more of the aforementioned embodiments, the level of power voltage or a current flowing in a power line may be measured and adjusted to improve display quality.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the invention as set forth in the following claims.

What is claimed is:

1. An organic light emitting display apparatus, comprising:

a timing controller to output a vertical synchronization signal;

a display to display a frame of image data based on the vertical synchronization signal;

a power supply to output first power and second power to the display through first and second power lines, respectively;

a sensor controller to output a sensor control signal synchronized with the vertical synchronization signal;

a sensor to measure current flowing through the first power line in synchronization with the sensor control signal; and a power controller to compare the measured current with a reference current value and to control the power supply based on results of the comparison, the power supply to be controlled to adjust a voltage level of the first power in synchronization with the sensor control signal, wherein the sensor control signal has a period based on dividing the vertical synchronization signal, and wherein the power controller is to:

generate a first delta value based on the results of the comparison, and adjust the voltage level of the first power to correspond to a value based on a sum of the voltage level of the first power and the first delta value.

2. The display apparatus as claimed in claim 1, wherein:

when the value obtained by adding the voltage level of the first power and the first delta value is lower than a first critical value, the power controller is to adjust the voltage level of the first power to be the first critical value.

3. The display apparatus as claimed in claim 1, wherein:

the sensor is to measure a voltage between the first and second power lines, and the power controller is to adjust the voltage level of the first power based on the measured voltage.

4. The display apparatus as claimed in claim 1, wherein the vertical synchronization signal is divided with a dividing ratio of 3.

5. The display apparatus as claimed in claim 1, wherein the power controller is to control the power supply to adjust the voltage level of the first power once during each of a plurality of periods of the sensor control signal.

6. The display apparatus as claimed in claim 1, wherein:

the display includes a plurality of pixels, each of the pixels includes at least one sub-pixel, and the power supply is to output the first power to the at least one sub-pixel of each of the pixels through different power lines according to types of the sub-pixels.

7. The display apparatus as claimed in claim 6, wherein:

the sensor is to measure current respectively flowing through the different power lines, and the power controller is to control the power supply based on the current respectively measured at the different power lines, in order to independently adjust the first power output through the different power lines.

8. The display apparatus as claimed in claim 1, wherein:

the display includes a plurality of pixel rows, a plurality of scan lines respectively connected to the pixel rows, and a plurality of data lines, each of the rows including a plurality of pixels, and the organic light emitting display apparatus includes:

a gate driver to output a scan signal to the scan lines; and a source driver to output data signals to the data lines in synchronization with the scan signal.

9. The display apparatus as claimed in claim 8, wherein:

the frame includes a plurality of sub-frames, and each of the sub-frames is for an image corresponding to a bit of the data signal, the frame to be expressed based on a sum of emitting periods of the sub-frames.

10. The display apparatus as claimed in claim 9, wherein:

one of the sub-frames corresponding to a most significant bit of the data signal has a longest emitting period, and another of the sub-frames corresponding to a least significant bit of the data signal has a shortest emitting period.

11. The display apparatus as claimed in claim 9, wherein the emitting periods of the sub-frames are different from each other based on a ratio of $2^n$.

12. The display apparatus as claimed in claim 9, wherein:

the gate driver is to sequentially output the scan signal to the scan lines according to each of the sub-frames, and the display is to simultaneously display image data corresponding to each of the sub-frames through pixels connected to the scanned scan lines.

13. The display apparatus as claimed in claim 9, wherein:

the gate driver is to individually output the scan signal to the scan lines according to timings individually determined for each of the scan lines, and the display is to individually display each of the sub-frames through pixels connected to the scanned scan lines according to the timings individually determined for each of the scan lines.

14. A method of driving an organic light emitting display apparatus, the method comprising:

outputting first power and second power to a display through first and second power lines, respectively;

generating a sensor control signal based on a divided vertical synchronization signal;

measuring current flowing through the first power line in synchronization with the sensor control signal;

comparing the measured current with a reference current value; and adjusting a voltage level of the first power based on the comparison, wherein adjusting the voltage level of the first power includes:

generating a first delta value based on the comparison, and adjusting the voltage level of the first power to correspond to a value obtained by adding the voltage level of the first power and the first delta value.

15. The method as claimed in claim 14, wherein:

when the value obtained by adding the voltage level of the first power and the first delta value is lower than a first critical value, adjusting the voltage level includes adjusting the voltage level of the first power to be the first critical value.

16. The method as claimed in claim 14, wherein:

measuring the current is performed by measuring a voltage between the first and second power lines in synchronization with the sensor control signal, and adjusting the voltage level is performed by adjusting the voltage level of the first power based on the measured voltage.

17. The method as claimed in claim 14, wherein adjusting the voltage level of the first power is performed once during each of a plurality of periods of the sensor control signal.

18. An apparatus, comprising:

an interface; and a controller to control a display, the controller to:

output first power and second power to the display through respective first and second power lines;

generate a sensor control signal based on a control signal;

measure current flowing through the first power line based on the sensor control signal; and adjust a voltage level of the first power based on the measured current, and wherein the controller is to:

compare the measured current with a reference current value, generate a first delta value based on the results of the comparison, and adjust the voltage level of the first power to correspond to a value based on a sum of the voltage level of the first power and the first delta value.

* * * * *